US007819499B2

(12) United States Patent
Sakurai

(10) Patent No.: US 7,819,499 B2
(45) Date of Patent: Oct. 26, 2010

(54) LIQUID DROPLET JETTING APPARATUS

(75) Inventor: Hisaki Sakurai, Aichi-ken (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 411 days.

(21) Appl. No.: 11/999,791

(22) Filed: Dec. 7, 2007

(65) Prior Publication Data

US 2008/0136865 A1 Jun. 12, 2008

(30) Foreign Application Priority Data

Dec. 11, 2006 (JP) ..... 2006-333051

(51) Int. Cl.
*B41J 2/165* (2006.01)

(52) U.S. Cl. ..... 347/31; 347/20; 347/22; 347/29; 347/30; 347/32

(58) Field of Classification Search ..... 347/29, 347/30, 31
See application file for complete search history.

(56) References Cited

U.S. PATENT DOCUMENTS

| | | | | |
|---|---|---|---|---|
| 6,017,109 | A * | 1/2000 | Saijo | 347/30 |
| 6,273,546 | B1 * | 8/2001 | Kobayashi et al. | 347/29 |
| 6,540,322 | B2 * | 4/2003 | Usui et al. | 347/29 |
| 6,672,715 | B2 | 1/2004 | Isono et al. | |
| 6,918,650 | B2 | 7/2005 | Umeda et al. | |
| 7,661,790 | B2 * | 2/2010 | Harada et al. | 347/36 |
| 2002/0033859 | A1 * | 3/2002 | Mitsuzawa et al. | 347/23 |
| 2002/0130918 | A1 * | 9/2002 | Hayakawa et al. | 347/29 |
| 2002/0130920 | A1 * | 9/2002 | Saijo | 347/31 |
| 2003/0081052 | A1 * | 5/2003 | Urrutia et al. | 347/31 |
| 2004/0027409 | A1 * | 2/2004 | Miyauchi | 347/30 |
| 2004/0027412 | A1 * | 2/2004 | Takahashi et al. | 347/34 |
| 2004/0252157 | A1 * | 12/2004 | Yamazaki et al. | 347/31 |
| 2007/0076046 | A1 * | 4/2007 | Toki | 347/31 |
| 2007/0171254 | A1 * | 7/2007 | Matsuoka et al. | 347/31 |

FOREIGN PATENT DOCUMENTS

| | | |
|---|---|---|
| JP | 7195712 | 8/1995 |
| JP | 2003080709 | 3/2003 |
| JP | 2004-058417 | 2/2004 |
| JP | 2004237464 | 8/2004 |
| JP | 2005262822 | 9/2005 |

* cited by examiner

*Primary Examiner*—Ryan Lepisto
(74) *Attorney, Agent, or Firm*—Frommer Lawrence & Haug LLP

(57) ABSTRACT

A liquid droplet jetting apparatus includes: a head having a jetting port surface in which a jetting port is formed; and a maintenance unit having a cap in which a discharge port is formed, an absorber arranged in the cap, and a suction mechanism which communicates with the discharge port. The absorber includes a first absorbing portion covering the discharge port, and a second absorbing portion arranged to be in contact with the first absorbing portion. A channel resistance of the first absorbing portion with respect to a liquid is higher than that of the second absorbing portion. Accordingly, when an idle suction is performed, it is possible to discharge uniformly a liquid absorbed in the first and absorbing portions.

12 Claims, 10 Drawing Sheets

LIQUID DROPLET JETTING APPARATUS

CROSS REFERENCE TO RELATED APPLICATION

The present application claims priority from Japanese Patent Application No. 2006-333051, filed on Dec. 11, 2006, the disclosure of which is incorporated herein by reference in its entirety.

BACKGROUND OF THE INVENTION

1. Field of the Invention

The present invention relates to a liquid droplet jetting apparatus which includes a liquid droplet jetting head which has a jetting port which jets a liquid droplet, and a cap which contactably moves with respect to the liquid droplet jetting head.

2. Description of the Related Art

As a liquid droplet jetting apparatus which includes a liquid droplet jetting head, an image recording apparatus including an ink-jet recording head which jets an ink on to a recording medium has been known. In such image recording apparatus, a maintenance of the recording head has hitherto been carried out for maintaining a jetting condition of the recording head to be favorable by removing forcibly air bubbles and thickened ink in the recording head.

As it has been described in Japanese Patent Application Laid-open No. 2004-58417, in the abovementioned maintenance, generally, a purge suction is carried out in a state in which a cap covers a nozzle formation surface of the recording head, the cap being movable contactably with respect to the nozzle formation surface of the head and being communicated to a pump (suction mechanism). A purge suction is an operation in which a negative pressure is generated inside the cap by the pump, and thickened ink and air bubbles are sucked forcibly from the nozzle, along with the ink. Accordingly, the thickened ink and/or the air bubbles are discharged to a waste-ink tank from a discharge port of the cap.

Moreover, after the purge suction, an idle suction (no-load suction) is also carried out. In other words, the pump is stopped once, and after separating the cap from the nozzle formation surface, the pump is operated again, and remained ink which has remained inside the cap without being completely discharged, is discharged from the discharge port. Accordingly, the ink which has remained inside the cap is prevented from contaminating the surrounding area and/or the ink which has remained inside the cap is prevented from contaminating the nozzle formation surface when the cap has covered the nozzle formation surface.

Generally, a rib, which is projected toward the nozzle formation surface and which is surrounding an area around a nozzle group, is formed in a cap for avoiding a direct contact of the cap with the nozzle. Since this rib is formed of an elastic body (an elastic material) such as rubber, when the cap contacts with the nozzle formation surface, a tip of the rib deforms elastically and makes a close contact with the nozzle formation surface. Therefore, it is possible to seal an interior space of the cap.

As shown in FIG. 10A, when a cap 551 is driven by an elevating mechanism (ascending and descending mechanism) which is not shown in the diagram, and has made a close contact with a nozzle formation surface 504*a* of a recording head 504, a space 601 is formed between the cap 551 and the nozzle formation surface 504*a*. Consequently, at the time of sucking the ink from the nozzle by a pump 656 which communicates with a discharge port 553 of the cap 551 at the time of the purge suction, the suction of the ink inside the nozzle starts after discharging the air in the space 601 firstly. Therefore, when a volume of the space 601 is large, it takes time till starting the suction from the nozzle, and there is a problem that it is not possible discharge efficiently the ink from the recording head 504 at the time of the purge suction.

Whereas, in FIG. 10B, an ink absorber 655 in the form of a sponge having a constant hole ratio all over is arranged at an interior of the cap 551. Accordingly, it is possible to absorb the ink by the ink absorber 655, and to reduce practically the space 601 which is formed between the cap 551 and the nozzle formation surface 504*a*. As a result, a suction efficiency of the purge suction is improved.

SUMMARY OF THE INVENTION

However, when the idle suction is carried out, the ink absorbed, in the ink absorber, near the discharge port 553 which communicates with the pump 656 is quickly discharged toward the pump 656. Therefore, the ink in the ink absorber 655 closer to the discharge port 553 is drained first. Since an upper surface of the ink absorber 655 is exposed to an atmosphere, air is sucked in from this upper surface (exposed surface). As a result, the ink at a site away from the discharge port 553 is not sucked easily. In other words, the ink is not sucked and discharged uniformly, and is remained in the ink absorber 655, and there is a problem that all the ink is not discharged from the discharge port 553.

The present invention is made for solving the abovementioned problems, and an object of the present invention is to realize a liquid droplet jetting apparatus which is capable of removing assuredly the ink which has remained in a cap, in an idle suction which is carried out with the cap separated from the jetting port surface.

According to a first aspect of the present invention, there is provided a liquid droplet jetting apparatus which jets a droplet of a liquid, including:

a head including a jetting port surface with a jetting port formed thereon, from which the droplet of the liquid is jetted; and a maintenance unit including: a cap which detachably covers the jetting port surface, and which has a surface facing the jetting surface and having a groove formed therein, the groove having a discharge port which discharges the liquid jetted from the jetting port formed therein; an absorber which is arranged in the groove, and which absorbs the liquid jetted from the jetting port, and which has a first absorbing portion covering the discharge port and a second absorbing portion arranged to be in contact with the first absorbing portion; and a suction mechanism which communicates with the discharge port to suck the liquid.

A channel resistance of the first absorbing portion with respect to the liquid is higher than that of the second absorbing portion.

According to the first aspect of the present invention, the absorber which is arranged in the groove which is formed in the cap (which is arranged along an inner wall of the cap) includes the first absorbing portion which covers the discharge port, and the second absorbing portion which is arranged at the other site, and the channel resistance of the first absorbing portion with respect to the liquid is higher than the channel resistance of the second absorbing portion. Consequently, at the time of carrying out an idle suction (no-load suction) of a liquid such as ink which has remained on an inner side of the cap, in a state that the cap is separated from the jetting port surface (nozzle formation surface), the liquid included (absorbed or soaked) in the first absorbing portion having a higher channel resistance is not discharged as easily as the liquid included (absorbed or soaked) in the second absorbing portion. As a result, it is possible to collect in the first absorbing portion, the liquid in the second absorbing portion which is away from the discharge port, while the liquid in the first absorbing portion near the discharge port is being discharged slowly. It is possible to discharge continuously, from the discharge port, the liquid inside the entire cap. In other words, since the liquid is discharged continuously without air being sucked into the absorber during the idle suction, it is possible to let the liquid be sucked and discharged evenly (uniformly), and to discharge the liquid assuredly without leaving the liquid which was sucked into the inner side of the cap.

In the liquid droplet jetting apparatus of the present invention, a plurality of holes may be formed in each of the first absorbing portion and the second absorbing portion, and a hole ratio of the first absorbing portion may be smaller than that of the second absorbing portion.

In this case, since the first absorbing portion has the hole ratio lower than the second absorbing portion, in other words, since a channel of liquid becomes narrow, or becomes small, it is possible to increase the channel resistance with respect to the liquid, and to discharge assuredly without allowing to remain the liquid sucked in the inner side of the cap in the idle suction.

In the liquid droplet jetting apparatus of the present invention, the cap may be formed to be box shaped which is open to the jetting port surface of the head, and the absorber may have a contact surface which makes a contact with an inner wall of the cap, and an exposed surface which is exposed to an outside of the cap; and a plurality of holes may be formed in each of the first absorbing portion and the second absorbing portion, and a hole ratio of the first absorbing portion on the exposed surface may be smaller than that of the second absorbing portion.

According to the liquid droplet jetting apparatus of the present invention, since the first absorbing portion has the hole ratio on the exposed surface which is exposed to the atmosphere, lower than the hole ratio of the second absorbing portion, not only the channel resistance with respect to the liquid, but also the channel resistance with respect to the atmosphere which is sucked from the exposed surface becomes high assuredly. Consequently, even when the liquid absorbed in the first absorbing portion is discharged from the discharge port at the time of idle suction, the air is not sucked easily into the first absorbing portion from the exposed surface side. As a result, the liquid in the second absorbing portion is collected to the discharge port, without being obstructed by the air, and it is possible to discharge assuredly the liquid in the entire absorber, from the discharge port.

In the liquid droplet jetting apparatus of the present invention, the first absorbing portion and the second absorbing portion may be formed of a first absorber and a second absorber having a hole ratio which is as same as that of the first absorber, respectively, and the first absorber may be arranged in the groove of the cap in a state that the first absorber is compressed harder than the second absorber.

In this case, the first absorbing portion and the second absorbing portion are made of a material having the same hole ratio. However, it is possible to adjust the actual hole ratio at the time of use by changing a degree of compression at the time of arranging in the cap. Therefore, as compared to a case of using materials having different initial hole ratio for the first absorbing portion and the second absorbing portion, it is possible to reduce a component cost. Moreover, by adjusting the degree of compression, it is possible to change easily the actual hole ratio at the time of using.

In the liquid droplet jetting apparatus of the present invention, the first absorbing portion and the second absorbing portion may include a plurality of first absorbing bodies and a plurality of second absorbing bodies, respectively, and a number of the first absorbing bodies per unit volume may be greater than a number of the second absorbing bodies per unit volume. Moreover, the first absorbing bodies and the second absorbing bodies may have a same hole ratio. In these cases, since the first absorbing bodies are arranged more densely than the second absorbing bodies, even when the first absorbing bodies and the second absorbing bodies have the same hole ratio, it is possible to make the channel resistance of the first absorbing portion to be higher than the channel resistance of the second absorbing portion. Therefore, it is possible to discharge assuredly without allowing to remain the liquid which has been sucked inside the cap in the idle suction.

In the liquid droplet jetting apparatus of the present invention, each of the first absorbing portion and the second absorbing portion may be made of a sponge or a felt. In the liquid droplet jetting apparatus of the present invention, each of the first absorbing portion and the second absorbing portion may be made of a material selected from a group consisting of urethane, pulp, and a high molecular liquid absorbing material. In these cases, it is possible to hold the liquid assuredly in the first absorbing portion and the second absorbing portion.

In the liquid droplet jetting apparatus of the present invention, the cap may have a bottom wall facing the jetting port surface of the head, and a side wall which is located to surround the bottom wall and which projects toward the jetting port surface of the head, and a tip of the side wall may be formed to be tapered toward the jetting port surface. In this case, it is possible to bring the cap in a close contact assuredly, at the time of bringing in contact with the jetting port surface of the head.

In the liquid droplet jetting apparatus of the present invention, the maintenance unit may further include a wiper which wipes the jetting port surface of the head. In this case, since the maintenance unit has the wiper, it is possible to remove assuredly dirt and dust etc. which is adhered to the jetting port surface.

In the liquid droplet jetting apparatus of the present invention, the hole ratio of the first absorbing portion and the hole ratio of the second absorbing portion may change gradually, across a surface parallel to the jetting port surface, depending on a distance from the discharge port. Moreover, the first absorbing portion and the second absorbing portion may include a plurality of first absorbing bodies and a plurality of second absorbing bodies, respectively, and a number of first absorbing bodies per unit volume and a number of second absorbing bodies per unit volume may gradually change, across a surface parallel to the jetting port surface, depending on a distance from the discharge port. In both the cases, since it is possible to make a channel resistance of the absorber, at a site close to the discharge port, to be higher than a channel resistance at a site far away from the discharge port, it is possible to discharge assuredly without allowing to remain, the liquid which has been sucked into the cap in the idle suction.

DETAILED DESCRIPTION OF THE PREFERRED EMBODIMENTS

An embodiment of the present invention will be described below with reference to the diagrams. In this embodiment, the present invention is applied to a multi-function device (MFD) 100 provided with functions such as a printer function, a copy function, a scanner function, and a facsimile function. The MFD 100 has a liquid droplet jetting apparatus 1 which realizes the printer function.

Figure 1:
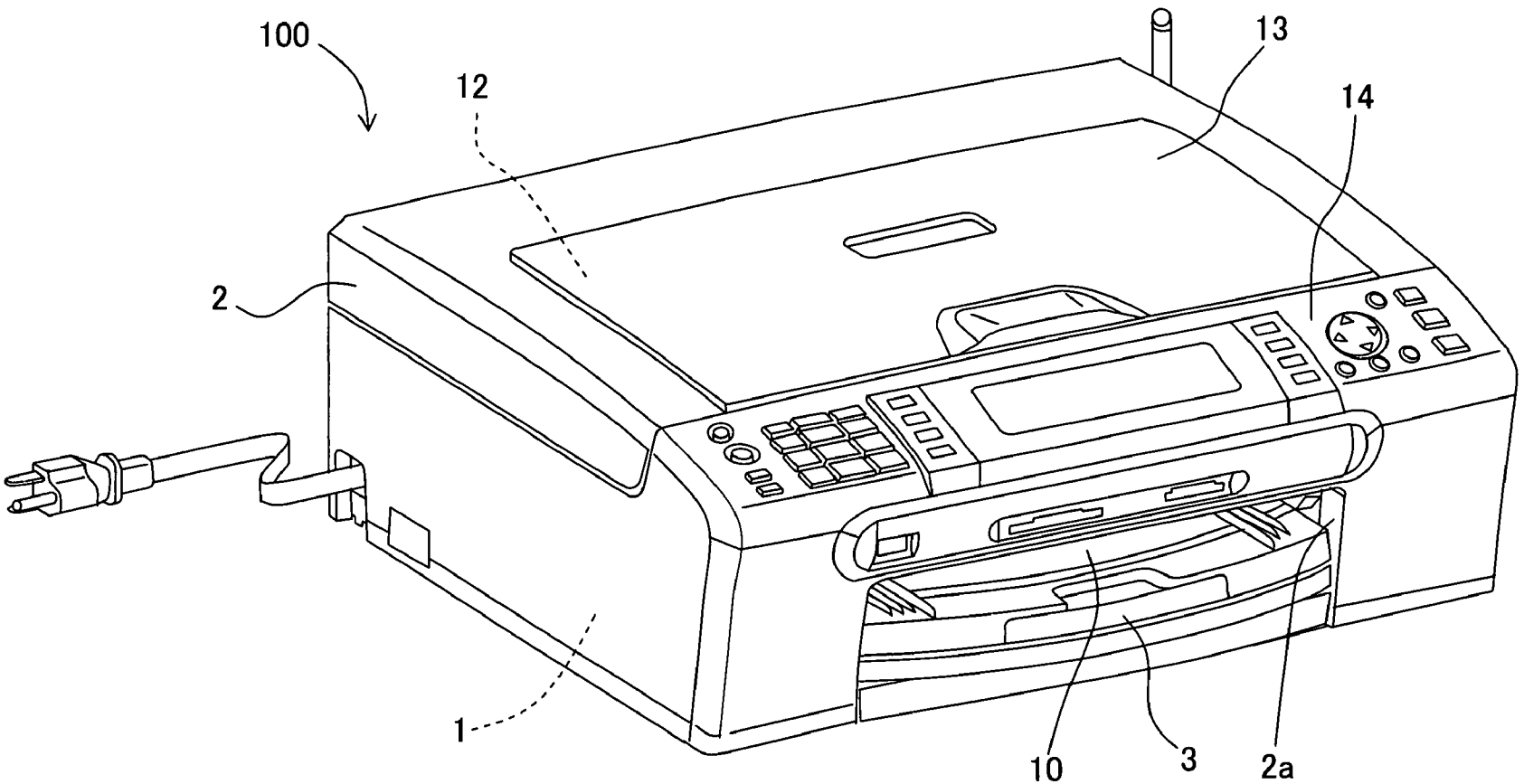
FIG. 1 is a perspective view of a multi-function device to which a liquid-droplet jetting apparatus of the embodiment is applied.

As shown in FIG. 1, the liquid-droplet jetting apparatus 1 includes a paper feeding cassette unit 3 which is provided at a lower portion of a main-body case (housing) 2 made of a synthetic resin material, of the MFD 100, and which is arranged to be inserted into and extracted from (practically, insertable and extractable in a horizontal direction) an insertion opening 2*a* which opens on a front side of the main-body case 2. An image reading unit 12, which is used for a document reading in the copy function and the facsimile function, is arranged on an upper portion of the main-body case 2. The image reading unit 12 is covered by a document cover 13 which is pivotably provided. In the following description, a side of the main-body case 2 made of a synthetic resin material, where the insertion opening 2*a* is located is called as a front (front face), and based on the front face, a rear (rear face), and a left and right (faces) are defined.

An operating section 14 which includes a panel display section such as a liquid-crystal display, and buttons and switches for carrying out various operations, is provided on a front-upper side of the main-body case 2. The liquid droplet jetting apparatus 1, a discharge tray 10 and the like are arranged at positions overlapping with the image reading unit 12 and the operating section 14 in a plan view. As shown in FIG. 2A, storage section 15 which stores ink cartridges 19 according to the number of ink colors is accommodated in a front-right side of the main-body case 2, and an ink in each of the ink cartridges 19 is supplied independently to a recording head 4, via an ink supply tube 20 which is flexible.

Figure 2:
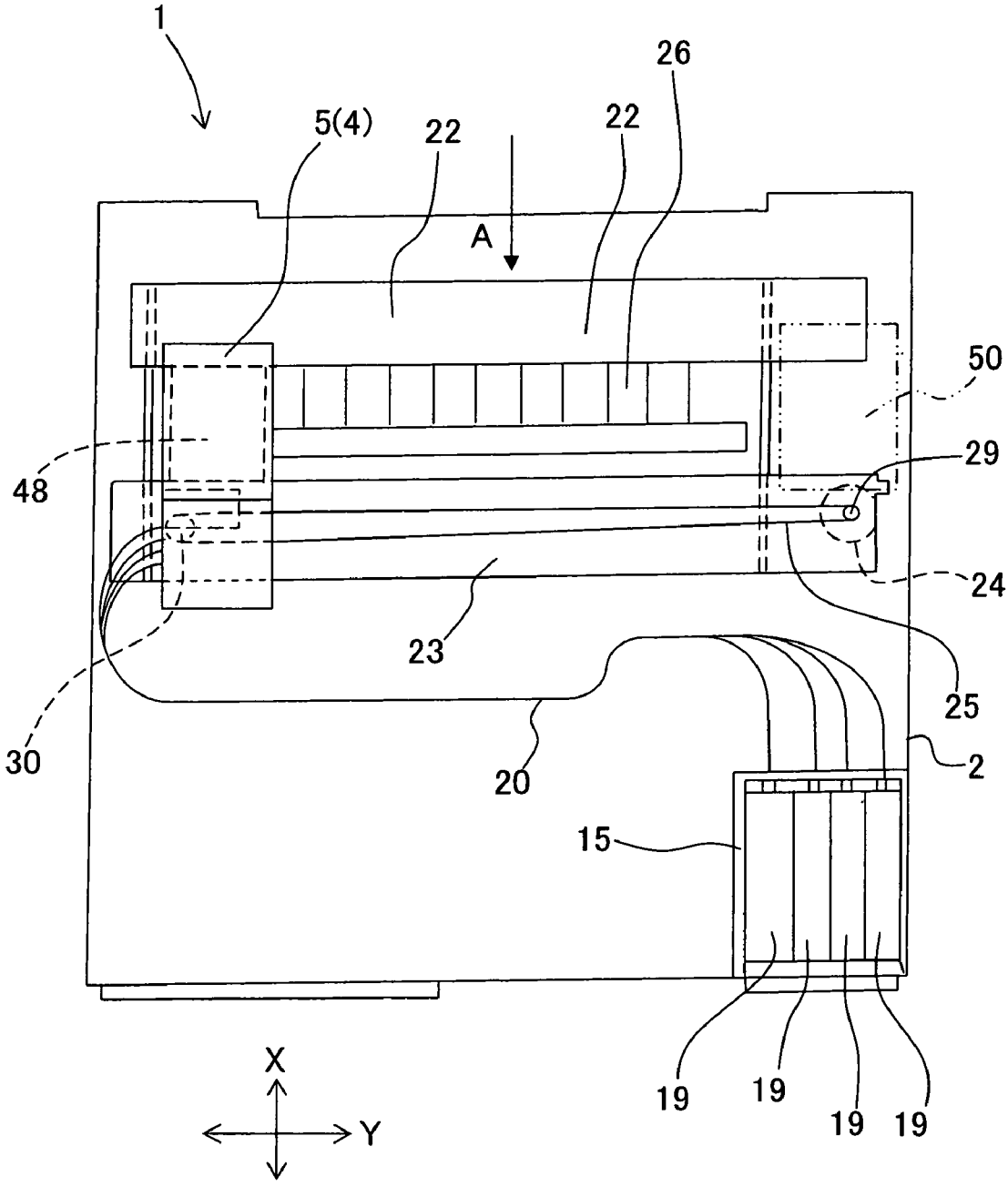
FIG. 2 is a schematic plan view of the liquid droplet jetting apparatus.

As shown in FIG. 2, the liquid-droplet jetting apparatus 1 has a recording head 4 mounted on a carriage 5, and a platen 26 facing a lower surface of the recording head 4. The carriage 5 is arranged to bridge between a first guide member 22 and a second guide member 23, the first and second guide members being plate-like members which are extended in a main scanning direction (Y axis direction). The carriage 5 reciprocates over the first guide member 22 and the second guide member 23. The recording head 4 is fixed to the carriage 5. On a lower surface of the recording head 4, a nozzle formation surface 4*a*, in which nozzles 6 which jet the ink are formed, is exposed.

A carriage motor (CR motor) 24 which drives the carriage 5 is arranged on a lower side of the second guide member 23 positioned at a downstream side of a transporting direction (direction of arrow A) of a paper which is a recording medium. A driven pulley 30, and a drive pulley 29 coupled with the carriage motor 24 are arranged on an upper side of the second guide member 23. A timing belt 25 which is linked with the carriage 5 is put around to couple the drive pulley 29 and the driven pulley 30. Accordingly, when the carriage motor 24 rotates, the carriage 5 reciprocates along the Y axis direction.

Figure 3:
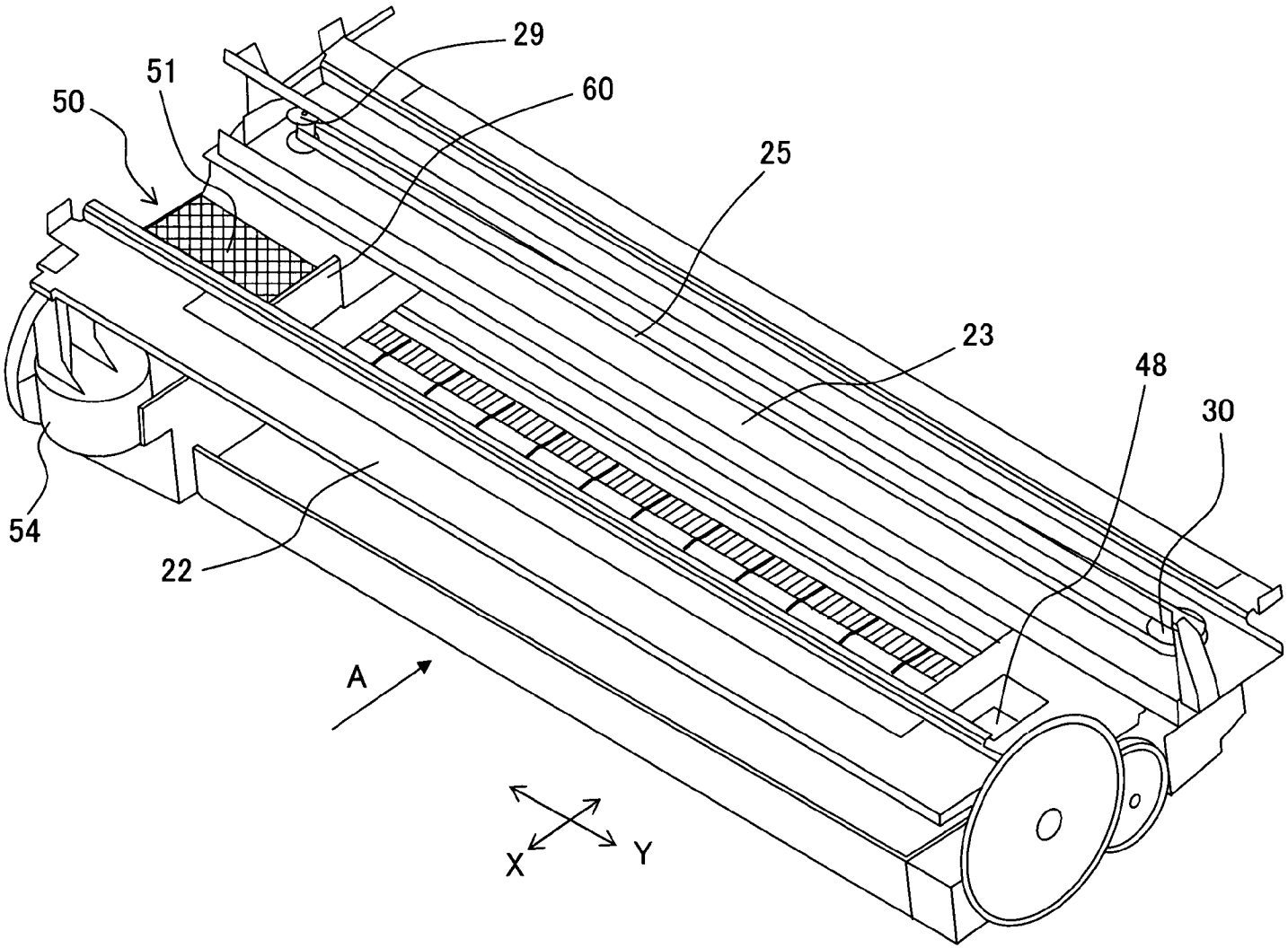
FIG. 3 is a perspective view of important components of the liquid droplet jetting apparatus, from a rear-surface side.

An ink receiving section 48 is provided at one outer side area of the transported paper in a width direction thereof (an area outside of the recording area), (left side in FIG. 2 and right side in FIG. 3). A maintenance unit 50 is provided at the other outer side area (right side in FIG. 2 and left side in FIG. 3). The ink receiving section 48 is arranged corresponding to a flushing position of the carriage 5. The recording head 4 periodically carries out ink jetting for preventing clogging of nozzles (jetting ports) at the flushing position, during a recording operation. The jetted ink is received in the ink receiving section 48. The maintenance unit 50 is arranged corresponding to a standby position (maintenance position, home position) of the carriage 5, and carries out a recovery operation (purging) for the recording head 4.

As shown in FIG. 3, the maintenance unit 50 is provided with a cap 51 which is connected to a suction pump 54 arranged on the main-body case 2, a wiper 60 which is arranged by the side of the cap 51 and which wipes the nozzle formation surface 4*a*, and an elevating mechanism (an ascending and descending mechanism, a moving mechanism) 61 which contactably moves (makes ascend and descend) the cap 51 and the wiper 60, with respect to the nozzle formation surface 4*a*.

Figure 4:
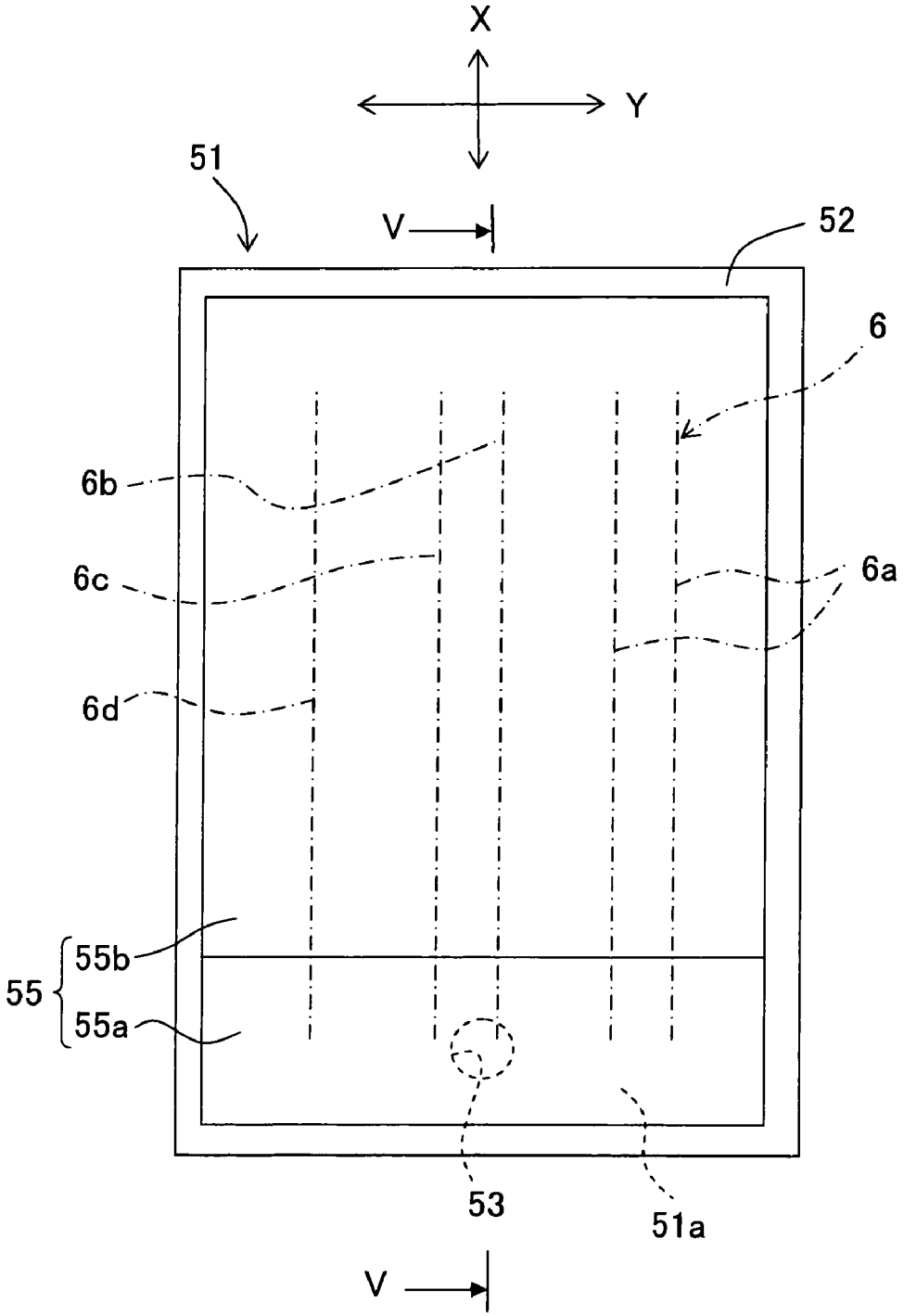
FIG. 4 is a top view of a cap.

In this embodiment, the nozzle formation surface 4*a* of the recording head 4 has a rectangular shape which is long in the X axis direction. As shown by alternate long and short dashed lines in FIG. 4, the nozzles 6 are arranged in rows extended in the X axis direction. FIG. 4 is a plan view (top view) of the cap 51, and the nozzles 6 are also shown in the diagram to make clear the positional relationship of the nozzles. In this embodiment, four colors of inks, namely, black, yellow, magenta, and cyan inks are jetted, but five rows of nozzles 6 are formed. Two rows 6*a* are for the black ink, and nozzle rows 6*b*, 6*c*, and 6*d* are for the yellow ink, magenta ink, and cyan ink respectively.

Figure 5:
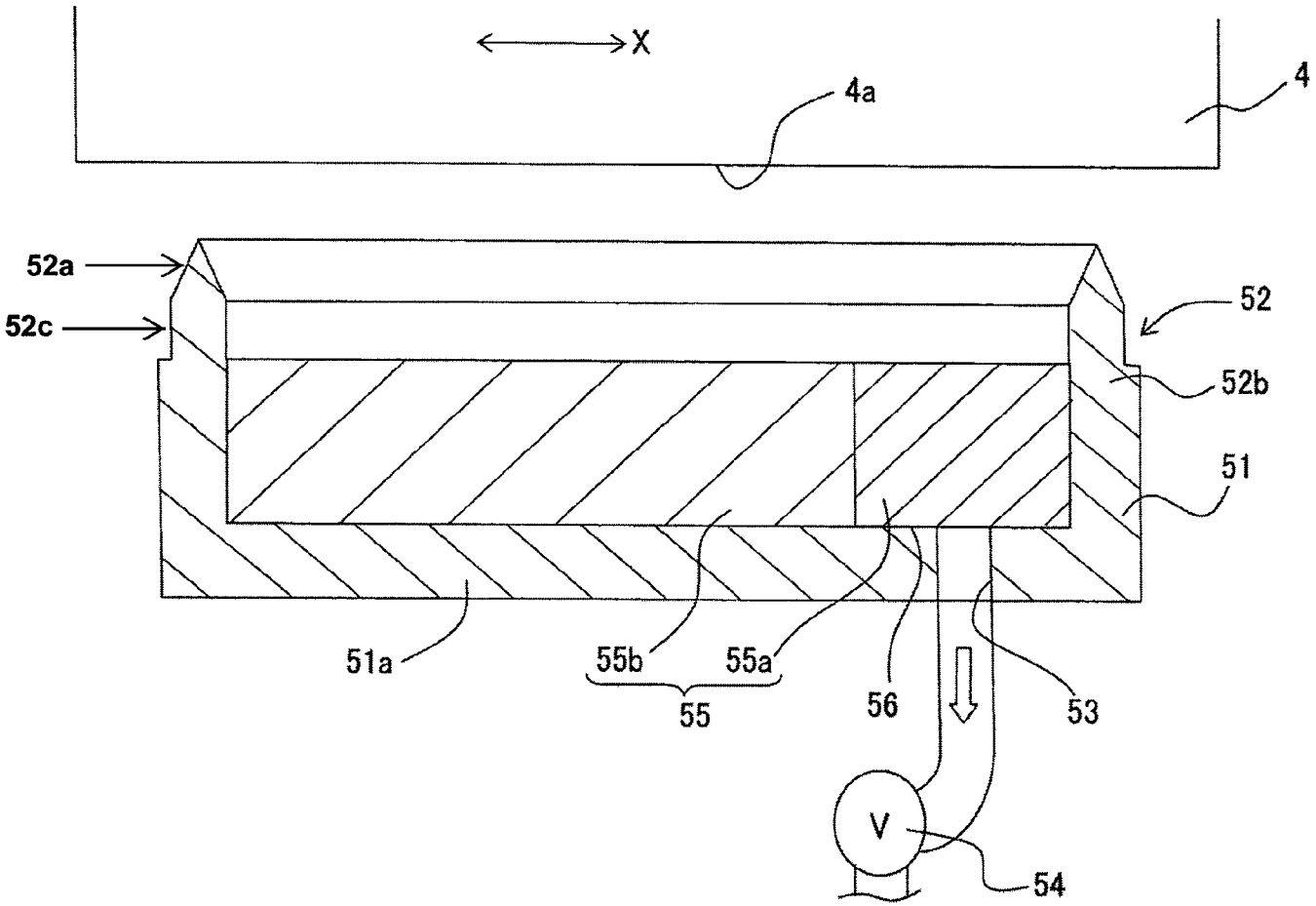
FIG. 5 is a cross-sectional view taken along a line V-V in FIG. 4.

As shown in FIG. 5, the cap 51 is a box shaped member which is formed of an elastic material such as rubber, and has an opening formed on a side of the nozzle formation surface 4*a* (upper surface side), and a rib 52 which is projected toward the nozzle formation surface 4*a*. The rib 52 is formed to be frame shaped, surrounding an outer circumference of a group of nozzles 6. In other words, the rib 52 is formed to be frame shaped with a longer side of the frame in the X axis direction, corresponding to the shape of the nozzle formation surface 4*a*.

The rib 52 is extended continuously from a side wall 52*b* of the cap 51. A tip portion (front-end portion) 52*a* of the rib 52 is formed integrally with the rib 52, and makes a close contact with the nozzle formation surface 4*a*. A portion of the rib 52 from a base end 52*c* up to a portion (just) before the tip portion 52 is formed to be almost of the same thickness, and the tip portion 52*a* is formed such that the thickness is gradually decreased (becomes thin) toward the front end. Therefore, a cross-sectional shape of the tip portion 52*a* has a substantially triangular shape, and the front end of the tip portion 52*a* is rounded. The tip portion 52*a* is deformable because the tip portion 52*a* has a tapered shape. Therefore, when the cap 51 has made a contact with the nozzle formation surface 4*a*, since the tip portion 52*a* deforms elastically, the close contact between the cap 51 and the nozzle formation surface 4*a* is improved.

As shown in FIGS. 4 and 5, a discharge port 53 which communicates with the suction pump 54 is formed in a bottom portion 51*a* of the cap 51. In this embodiment, only one discharge port 53 is arranged at a position near one end, in a longitudinal direction of the cap 51, on a central line extended in a longitudinal direction (X axis direction) of the bottom portion 51*a*. As it will be described later, the position of the discharge port 53 is not limited in particular, and the discharge port 53 may be formed as a plurality of discharge ports.

On an inner side of the cap 51, an absorber (an ink absorber) 55 is arranged to make a close contact with the side wall 52*b*, covering an entire surface of the bottom portion 51*a*. The ink absorber 55 has a rectangular shape which is long in the X axis direction, and corresponds to the shape of the bottom portion 51*a* of the cap 51. The ink absorber 55 has a height (thickness) such that a constant (a uniform) gap is formed between the nozzle formation surface 4*a* and an upper surface of the ink absorber 55, when the cap 51 is brought in close contact with the nozzle formation surface 4*a*.

The ink absorber 55 has a contact surface 56 which makes a contact with the bottom portion 52*a* to cover the discharge port 53, and an exposed surface 57 which is exposed to an atmosphere. Since the ink absorber 55 is arranged in the cap 51, it is possible to decrease a volume of an inner space (interior space), which is formed when the rib 52 of the cap 51 has made a close contact with the nozzle formation surface 4*a*, and it is also possible to carry out the maintenance efficiently by the suction pump 54.

The ink absorber 55 is formed of a material having a multiple number of minute holes (or air gaps), such as a sponge or a felt. Specifically, the ink absorber may be formed of urethane, pulp, and a high-molecular water (liquid) absorbing material. Therefore, the ink absorber 55 is capable of absorbing and holding an ink, and when a negative pressure is applied to the cap 51 by the suction pump 54 via the ink absorber 55 at the time of the purge suction, the ink absorber 55 is capable of making the ink flow out promptly. The ink absorber 55 includes two ink absorbing portions having different channel resistance with respect to the ink namely, a first ink absorbing portion 55*a* and a second ink absorbing portion 55*b*. The first ink absorbing portion 55*a* having a high channel resistance is arranged at a site covering the discharge port 53, and the second ink absorbing portion 55*b* having a low channel resistance is arranged at the other site.

A hole ratio (proportion of holes in each absorbing material) of the first ink absorbing portion 55*a* is smaller than a hole ratio of the second ink absorbing portion 55*b*. In other words, since a gap (channel), which allows the ink to pass, in the first ink absorbing portion 55*a* is smaller or narrower than that in the second ink absorbing portion 55*b*, the channel resistance of the first ink absorbing portion 55*a* is higher than that of the second ink absorbing portion 55*b*.

In this embodiment, a material having the same hole ratio is used for the first ink absorbing portion 55*a* and the second ink absorbing portion 55*b*, and the substantial hole ratio (a final hole ratio) is let to be different by changing a compressibility at the time of arranging on the inner side (at the interior) of the cap 51. In other words, as compared to the second ink absorbing portion 55*b*, the first ink absorbing portion 55*a* is compressed strongly (compressed hard) and arranged in the cap 51.

Since the final hole ratio of the ink absorbing material is adjusted by changing a degree (level) of compression in such manner, it is not necessary to prepare (arrange) a plurality of materials having different hole ratio, as the material of the ink absorbing material, and it is possible to reduce a component cost. Moreover, stronger the compression, the hole ratio can be reduced to be even smaller. Therefore, it is possible to adjust the hole ratio easily.

For carrying out the purge suction, firstly, the recording head is moved to a purge-suction position by driving the carriage 5. The cap 51 is brought in a contact with the nozzle formation surface 4*a* by an elevating mechanism (lifting mechanism) which is not shown in the diagram. At this time, the tip portion 52*a* of the rib 52 deforms elastically, and makes a close contact with the nozzle formation surface 4*a*. Next, the suction pump 54 is driven (turned on) and a space formed in the cap 51 is negatively pressurized. Accordingly, thickened ink and air bubbles inside the recording head 4 are sucked forcibly from the nozzle 6, along with the ink. The ink sucked from the nozzle 6 is absorbed once in the ink absorber 55, and is discharged from the discharge port 53.

After the purge suction is terminated, the suction pump 54 is stopped, and the cap 51 is separated apart from the nozzle formation surface 4*a* by the elevating mechanism. In this state, the suction pump 54 is driven again, and an idle suction (no-load suction) is carried out, and the ink remained in the cap 51 is discharged from the discharge port 53.

At this time, the ink included in (absorbed in) the first ink absorbing portion 55*a* is discharged from the discharge port 53. However, since the discharge port 53 is covered by the first ink absorbing portion 55*a* having high channel resistance, the ink absorbed in the first ink absorbing portion 55*a* moves toward the discharge port 53 at a slow speed. Whereas, since the channel resistance of the second ink absorbing portion 55*b* is lower than the channel resistance of the first ink absorbing portion 55*a*, a speed of the ink moving inside the second ink absorbing portion 55*b* is faster than the speed of the ink moving inside the first ink absorbing portion 55*a*. Therefore, while the ink of the first ink absorbing portion 55*a* is sucked and discharged slowly from the discharge port 53, the ink absorbed in the second ink absorbing portion 55*b* is promptly (quickly) gathered toward the discharge port 53, and is discharged in continuation with the ink of the first ink absorbing portion 55*b*.

In this embodiment, since the ink absorbed in the first ink absorbing portion 55*a* having high channel resistance is discharged slowly, a path of air is hardly formed between the discharge port 53 and the exposed surface 57 of the first ink absorbing portion 55*a* near the discharge port 53. Moreover, since the first ink absorbing portion 55*a* and the second ink absorbing portion 55*b* are in contact, a path of air is hardly formed between the first ink absorbing portion 55*a* and the second ink absorbing portion 55*b*. Therefore, it is possible to prevent a phenomenon in which air sucked from the exposed surface 57 is discharged from the discharge port 53, before the ink absorbed in the second ink absorber 55*b*, which is arranged at a position away from the discharge port 53, is discharged from the discharge port 53. Therefore, it is possible to remove uniformly by the idle suction, the ink remained on the inner side of the cap 51.

Figure 6:
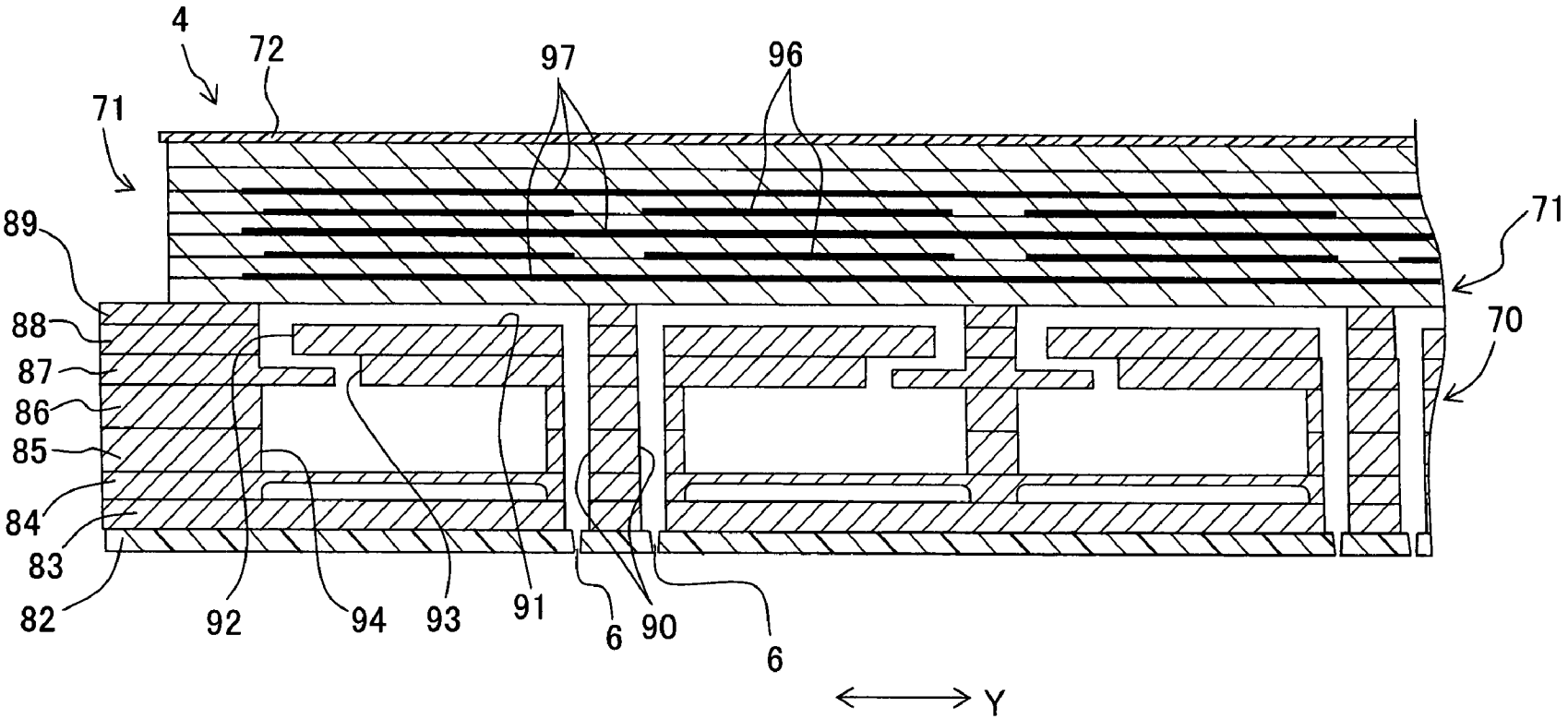
FIG. 6 is a partial cross-sectional view of a recording head.

Next, the recording head 4 to which this embodiment is applicable will be described below. As shown in FIG. 6, the recording head 4 includes: a cavity unit 70 which has a nozzle 6, a pressure chamber 91, a common ink chamber 94 and other ink channels; a piezoelectric actuator 71 which selectively applies a jetting pressure to the ink in the pressure chamber 91 of the cavity unit 70; and a flexible flat cable 72 which transmits a drive signal to the piezoelectric actuator 71. The cavity unit 70, the piezoelectric actuator 71, and the flexible flat cable 72 are arranged in a stacked form.

Figure 7:
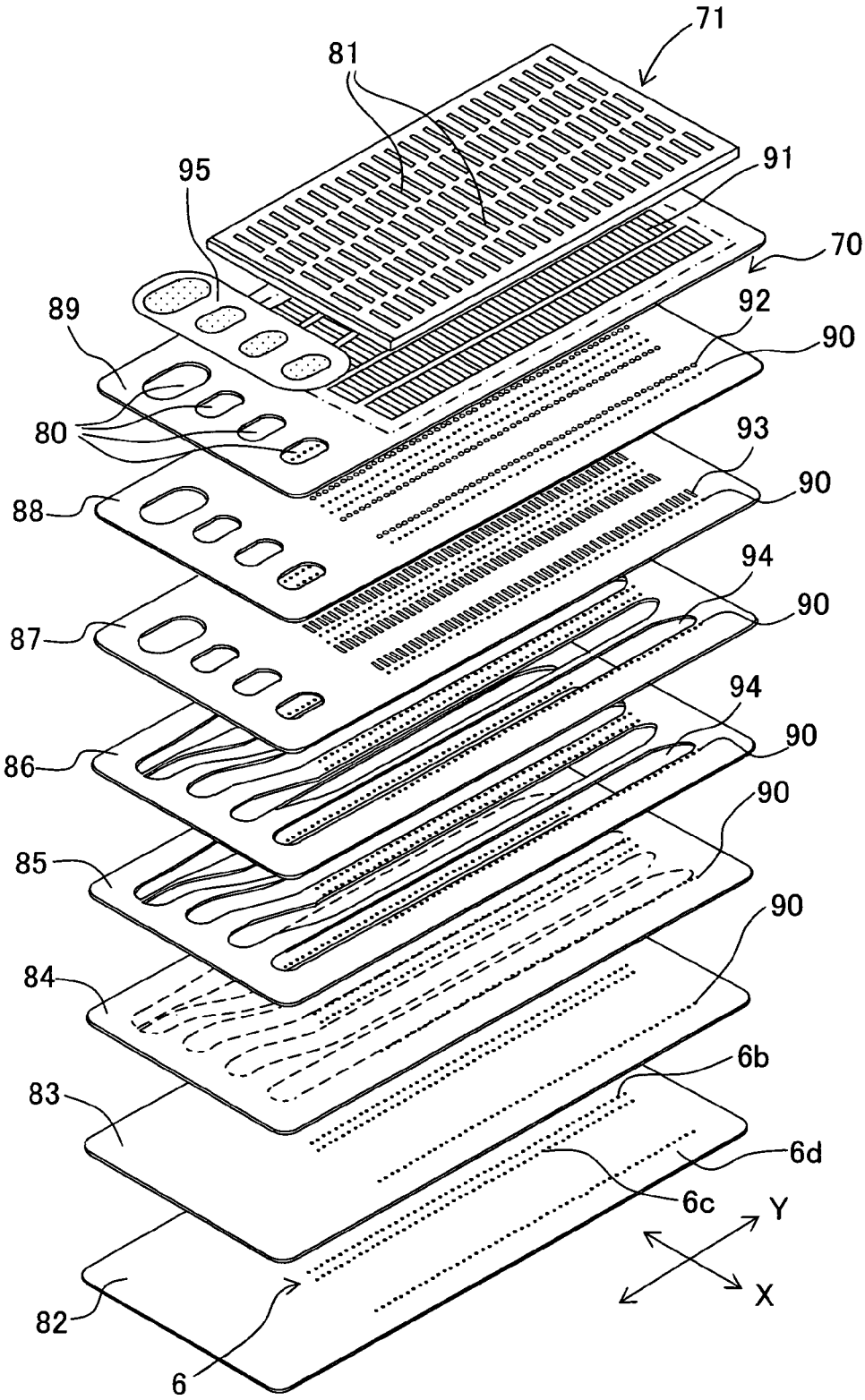
FIG. 7 is an exploded perspective view of a cavity unit.

The piezoelectric actuator 71 is slightly smaller than the cavity unit 70, and is stacked on a rear surface of the cavity unit 70, at a position toward one short side. As shown in FIG. 7, at a position toward the other short side on the reverse surface of the cavity unit 70, an ink intake port 80 which intakes ink from a side of the ink cartridge 19 is formed.

The flexible flat cable 72 has a shape of a belt, and one end in a longitudinal direction thereof is electrically connected to an external electrode 81 of the piezoelectric actuator 71. The flexible flat cable 72 is drawn in the X direction, and the other end thereof is electrically connected to a main-body side.

As shown in FIGS. 6 and 7, the cavity unit 70 includes a nozzle plate 82, a spacer plate 83, a damper plate 84, two manifold plates 85 and 86, a supply plate 87, a base plate 88, and a cavity plate 89, and these eight thin flat plates are stacked and joined by an adhesive.

In the cavity plate 89, at the uppermost layer, five rows of pressure chambers are arranged, and each row of pressure chamber includes a plurality of pressure chambers 91 arranged along the Y (axis) direction. In the nozzle plate 82, at the lowermost layer, nozzles 6 having a fine diameter corresponding to the pressure chambers 91, are arranged. In other words, in the nozzle plate 82 at the lowermost layer, five nozzle rows are arranged, and each nozzle row includes a plurality of nozzles 6 arranged along the Y (axis) direction. The nozzles 6 are connected to one end of the pressure chamber 91 of the cavity plate 89, via a through passage 90 which is cut through the plates 83 to 88. Moreover, the other end of the pressure chamber 91 communicates with the common ink chamber 94 via a communicating hole 92 formed in the base plate 88, and a connecting channel 93 formed in the supply plate 87.

In the two manifold plates 85 and 86, five grooves which are longer along the X direction are formed, and a common ink chamber (manifold chamber) 94 is formed by covering an upper surface thereof by the supply plate 87, and by covering a lower surface thereof by the damper plate 84. The ink intake port 80 communicates with one end in a longitudinal direction, of the common ink chamber 94.

Since the nozzles jetting the black ink are arranged as two nozzle rows, one ink intake port 80 is connected to the two common ink chambers 94 and 94. A filter 95 is adhered collectively to the four ink intake ports 80.

An ink channel is formed in the cavity unit 70, the ink channel ranging from the ink intake port 80 to the pressure chamber 91 via one end of the common ink chamber 94, the connecting channel 93 and the communicating hole 92, and furthermore, the ink channel reaching the nozzle 6 via the through passage 90.

The piezoelectric actuator 71 is an actuator in the form of a plate having a size covering all pressure chambers 91. Similarly as a hitherto known piezoelectric actuator disclosed in Japanese Patent Application Laid-open No. 2005-322850, a ceramics layer such as lead zirconate titanate (PZT) layer is stacked (in the piezoelectric actuator 71). The ceramics layer is sandwiched by (between) an individual electrode 96 which is formed corresponding to each pressure chamber 91, and a common electrode 97 which is common for the plurality of pressure chambers 91. A portion of the ceramics layer which is sandwiched by these electrodes forms an active portion. The active portion is capable of imparting (generating) selectively a pressure wave in the ink inside the pressure chambers 91 by applying a predetermined voltage between the common electrode 97 and the individual electrode 96.

Similarly as hitherto known (individual electrode and common electrode) disclosed in Japanese Patent Application Laid-open No. 2003-80709, the individual electrode 96 and the common electrode 97 are electrically connected to the external electrode 81 on the uppermost surface of the piezoelectric actuator 11 via a through hole. Further, the external electrode 81 and the flexible flat cable 72 are connected mechanically and electrically.

A drive-circuit unit (driver IC) not shown in the diagram, which outputs a drive signal to the piezoelectric actuator 71 is mounted on the flexible flat cable 72. The active portion is driven selectively to apply the jetting pressure to the pressure chamber 91 by the drive signal input from the drive-circuit unit, and the ink is jetted from the nozzle 6 communicating with that pressure chamber 91.

The recording head 4 is an example of a recording head to which the present invention is applied. However, as it has been mentioned earlier, the position of the first ink absorbing portion 55*a* which is arranged in the cap 51 is determined by a position of the discharge port 53 which is formed in the cap 51. In other words, the position of the first ink absorbing portion 55*a* is determined irrespective of a structure of ink channels in the recording head 4, the color of the ink jetted from the nozzle row, a direction in which the nozzle rows are arranged or the like.

Figure 8A:
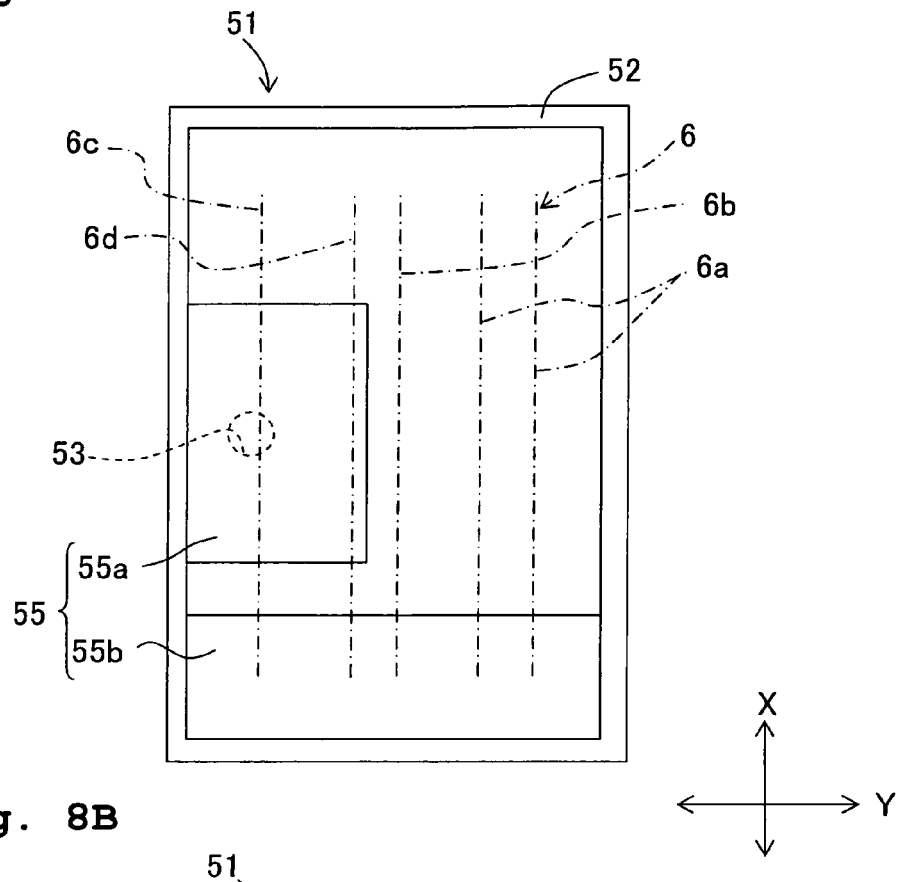
FIG. 8A and FIG. 8B are other modified embodiments of an ink absorber.

As shown in FIG. 8A, when the discharge port 53 is arranged at a position toward one longer side, the position of the first ink absorbing portion 55*a* is also adjusted according to the position of the discharge port 53. Moreover, when the discharge port 53 is formed in a side wall of the cap 51, the first ink absorbing portion 55*a* is to be arranged such that the discharge port 53 is covered by a side wall (surface facing the side wall) of the first ink absorbing portion 55*a*. Furthermore, when two or more discharge ports 53 are formed in the cap 51, at more than two locations, more than two pieces of the first ink absorbing portion 55*a* are to be arranged corresponding to these discharge ports 53. As a matter of course, when a gap between the adjacent discharge ports 53 is small, these discharge ports 53 may be covered by one first ink absorbing portion 55*a*.

Figure 8B:
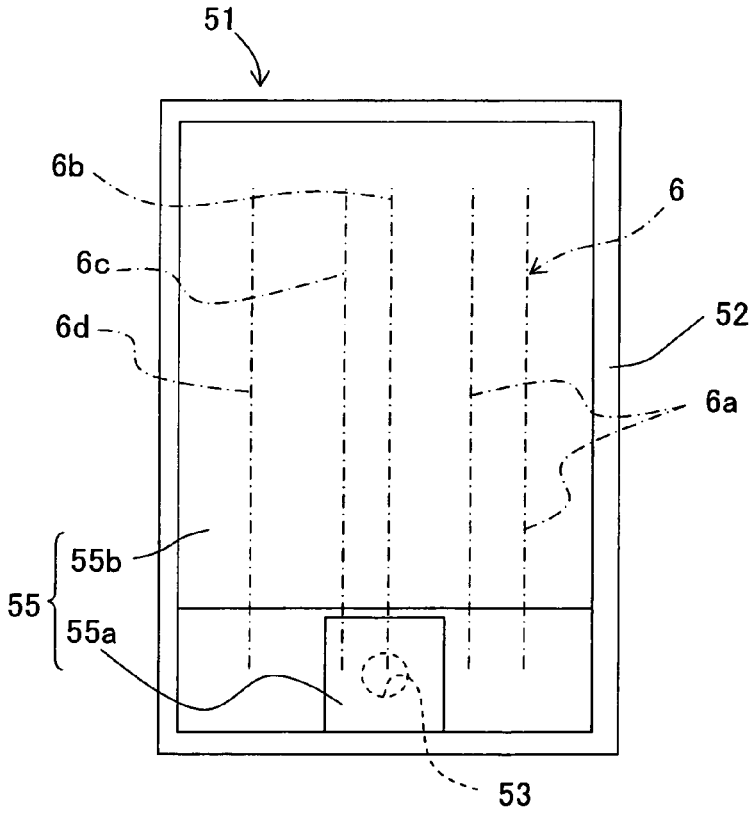

Moreover, an area of the first ink absorbing portion 55*a* (area of an upper surface or a lower surface of the first ink absorbing portion 55*a*) may be changed appropriately according to various conditions such as the hole ratio thereof. In FIG. 8B, a case in which the discharge port 53 is formed at a position near the one end of the cap 51 in the longitudinal direction, and the area of the first ink absorbing portion 55*a* is decreased (made small) is exemplified.

In this embodiment, the first ink absorbing portion and the second ink absorbing portion were independent members. However, the present invention is not restricted to such structure. A part from forming the ink absorber by combining two ink absorbing portions having different hole ratio as mentioned above, one ink absorber having a plurality of portions of different hole ratio may be used. Moreover, in this embodiment, the first ink absorbing portion and the second ink absorbing portion are formed of the same material, and the hole ratio was adjusted by changing a compressibility. However, the present invention is not restricted to such arrangement. For example, two ink absorbing materials having different hole ratio may be prepared, and these two ink absorbing materials may be arranged in the cap upon compressing to the same degree.

Moreover, each of the first ink absorbing portion and the second ink absorbing portion may not be formed of one material (the same material). For example, the first ink absorbing portion and the second ink absorbing portion may be formed by filling a plurality of small absorbing bodies (such as small sponge members) while compressing. In this case, it is possible to make the hole ratio of the first ink absorbing portion to be higher than that of the second ink absorbing portion by letting the number of small absorbing bodies (a density of the small absorbing bodies) of the first ink absorbing portion per unit volume to be higher than the number of small absorbing bodies of the second ink absorbing portion per unit volume, in other words, by filling the small absorbing bodies of the first ink absorbing portion more densely than the small absorbing bodies of the second ink absorbing portion. Instead of this, or, in addition to this, a material having a hole ratio lower than the hole ratio of the small absorbing bodies of the second ink absorbing portion may be used as the small absorbing bodies of the first ink absorbing portion. Or, a material larger than the small absorbing bodies of the second ink absorbing portion may be used upon compressing strongly (hard), as the small absorbing bodies of the first ink absorbing portion.

In the ink absorbing bodies of the embodiment described above, the hole ratio had been changing in a discontinuous manner between the first and second ink absorbing portions. However, the present invention is not restricted to this, and the hole ratio in the ink absorbing bodies may change in a continuous manner. For example, as it has been mentioned above, in a case in which the first ink absorbing portion and the second ink absorbing portion is formed by filling the small absorbing bodies, it is possible to realize the ink absorber of which the hole ratio changes in a continuous manner by changing the density of the small absorbing bodies gradually according to a distance from the discharge port.

Figure 9:
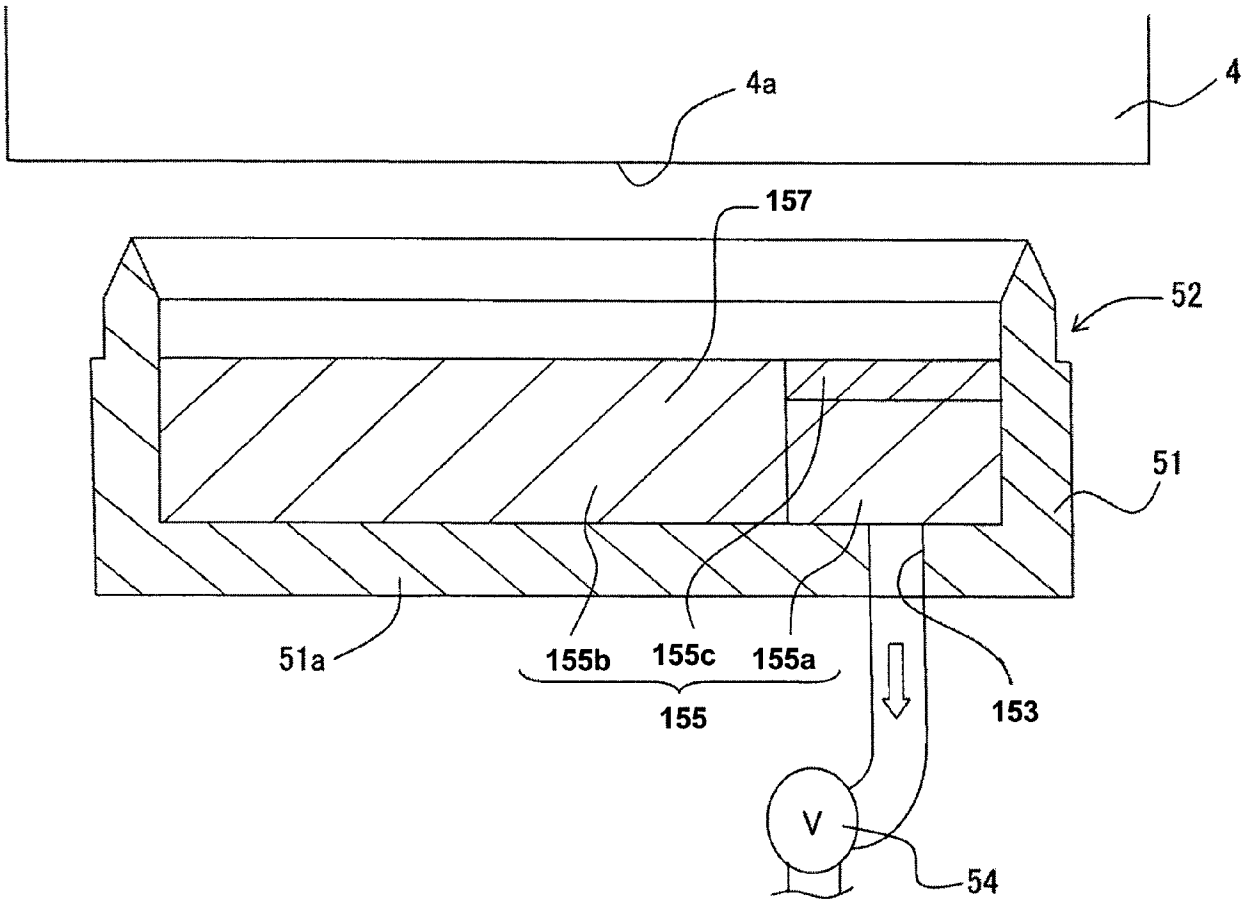
FIG. 9 is another modified embodiment of the ink absorber.
Figure 10A:
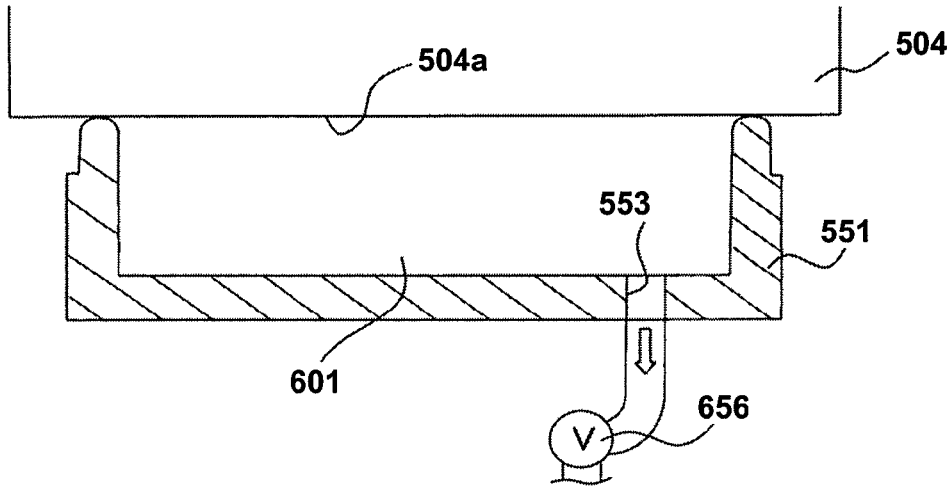
FIG. 10A and FIG. 10B are cross-sectional views of a conventional cap.
Figure 10B:
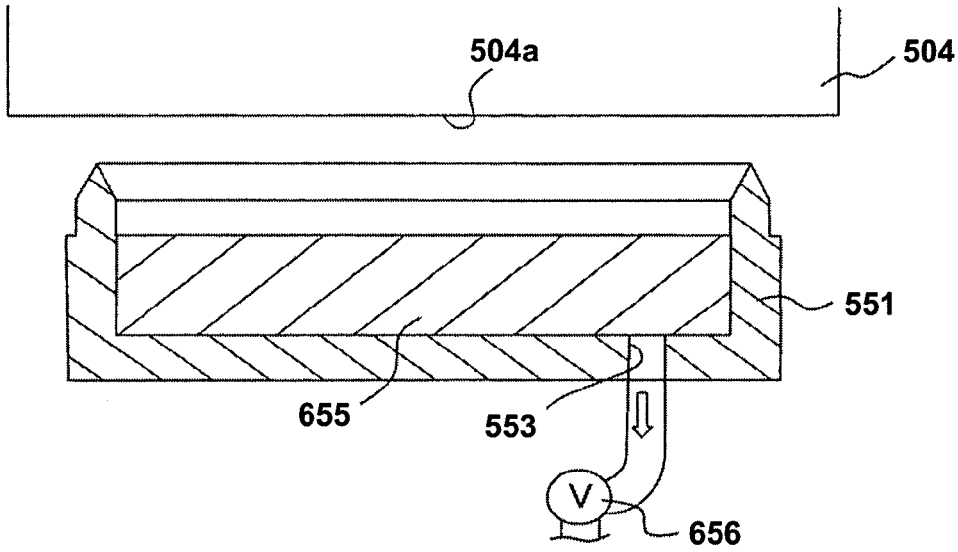

In FIG. 9, as a modified embodiment of the embodiment described above, an ink absorber 155 of a first ink absorbing portion 155*a*, in which a hole ratio of an exposed surface 157 is reduced, is shown. As it has been mentioned above, for a perfect (complete) discharge of the ink, making an arrangement such that a passage (path) of air is not created easily between the exposed surface 157 and a discharge port 153 is effective. Consequently, instead of lowering a hole ratio of the entire first ink absorbing portion 155*a*, the hole ratio of the exposed surface 157 is lowered, and an intake of air is reduced. Accordingly, an effect similar to the effect of the ink absorber in the embodiment described above is achieved.

For reducing the hole ratio of the exposed surface 157, it is possible to realize (the reduction in the hole ratio) by forming the first ink absorbing portion 155*a* and a second ink absorbing portion 155*b* of a material having the same hole ratio, and applying a rough coating only to the exposed surface 157 of the first ink absorbing portion 155*a*. As shown in FIG. 9, a low hole-ratio layer 155*c* in which holes are made smaller or fewer is formed toward the exposed surface 157 of the first ink absorbing portion 155*a* by applying the coating (in FIG. 9, a dimension in a direction of thickness is highlighted). By the low hole-ratio layer 155*c*, it is possible to increase (improve) assuredly a channel resistance of air which is taken into the first absorbing portion 155*a*.

In the abovementioned description, the rib is formed integrally with the side wall of the cap. However, the rib may not be necessarily formed integrally with the cap, and may be formed as a double layered structure in which a surface of the side wall of the cap is covered by an elastic material such as rubber. Moreover, regarding the number of colors of the ink, and the number of nozzle rows, it is not necessary to restrict to the abovementioned description, and the number of colors and the number of nozzle rows may be set arbitrarily. In the abovementioned description, the maintenance unit included the wiper. However, the maintenance unit may not necessarily include the wiper. Moreover, in the abovementioned description, the liquid droplet jetting apparatus was included in the multi-function device having the printer function. However, the present invention is not restricted to such an arrangement. The present invention is applicable to various liquid droplet jetting apparatuses which are used for various purposes such as forming a fine wiring pattern on a substrate by jetting an electroconductive paste, or forming a highly defined display by jetting an organic emitter (illuminant) on to a substrate, and further, forming a microelectronic device such as an optical guided wave path by jetting an optical resin on to a substrate.

What is claimed is:

1. A liquid droplet jetting apparatus which jets a droplet of a liquid, comprising:

a head including a jetting port surface with a jetting port formed thereon, from which the droplet of the liquid is jetted; and a maintenance unit including:

a cap which detachably covers the jetting port surface, and which has a surface facing the jetting port surface and having a groove formed therein, the groove having a discharge port which discharges the liquid jetted from the jetting port formed therein;

an absorber which is arranged in the groove, and which absorbs the liquid jetted from the jetting port, and which has a first absorbing portion covering the discharge port and a second absorbing portion arranged to be in contact with the first absorbing portion; and a suction mechanism which communicates with the discharge port to suck the liquid;

wherein a channel resistance of the first absorbing portion with respect to the liquid is higher than a channel resistance of the second absorbing portion;

wherein the cap is formed to be box shaped which is open to the jetting port surface of the head, and the first absorber has a contact surface which makes a contact with a portion of an inner wall of the cap, the discharge port is formed on the portion and an exposed surface which is exposed to an outside of the cap;

wherein a plurality of holes is formed in each of the first absorbing portion and the second absorbing portion, and a hole ratio of the first absorbing portion on the exposed surface is smaller than a hole ratio of the second absorbing portion; and wherein the liquid absorbed in the second absorbing portion is sucked to the discharge port through the first absorbing portion.

2. The liquid droplet jetting apparatus according to claim 1;

wherein a plurality of holes is formed in each of the first absorbing portion and the second absorbing portion, and a hole ratio of the first absorbing portion is smaller than a hole ratio of the second absorbing portion.

3. The liquid droplet jetting apparatus according to claim 1;

wherein the first absorbing portion and the second absorbing portion are formed of a first absorber and a second absorber, having a hole ratio which is as same as a hole ratio of the first absorber, respectively, and the first absorber is arranged in the groove of the cap in a state that the first absorber is compressed harder than the second absorber.

4. The liquid droplet jetting apparatus according to claim 1;

wherein the first absorbing portion and the second absorbing portion include a plurality of first absorbing bodies and a plurality of second absorbing bodies, respectively, and a number of the first absorbing bodies per unit volume is greater than a number of the second absorbing bodies per unit volume.

5. The liquid droplet jetting apparatus according to claim 4;

wherein the first absorbing bodies and the second absorbing bodies have a same hole ratio.

6. The liquid droplet jetting apparatus according to claim 1;

wherein each of the first absorbing portion and the second absorbing portion is made of a sponge or a felt.

7. The liquid droplet jetting apparatus according to claim 1;

wherein each of the first absorbing portion and the second absorbing portion is made of a material selected from a group consisting of urethane, pulp, and a high molecular liquid absorbing material.

8. The liquid droplet jetting apparatus according to claim 1;

wherein the cap has a bottom wall facing the jetting port surface of the head, and a side wall which is located to surround the bottom wall and which projects toward the jetting port surface of the head, and a tip of the side wall is formed to be tapered toward the jetting port surface.

9. The liquid droplet jetting apparatus according to claim 1;

wherein the maintenance unit further includes a wiper which wipes the jetting port surface of the head.

10. The liquid droplet jetting apparatus according to claim 1;

wherein the hole ratio of the first absorbing portion and the hole ratio of the second absorbing portion change gradually, across a surface parallel to the jetting port surface, depending on a distance from the discharge port.

11. The liquid droplet jetting apparatus according to claim 10;

wherein the first absorbing portion and the second absorbing portion includes a plurality of first absorbing bodies and a plurality of second absorbing bodies, respectively, and a number of first absorbing bodies per unit volume and a number of second absorbing bodies per unit volume gradually changes, across a surface parallel to the jetting port surface, depending on a distance from the discharge port.

12. The liquid droplet jetting apparatus according to claim 1;

wherein the exposed surface of the first ink absorbing portion has a coating applied so as to make holes formed on the exposed surface smaller.

* * * * *